US006722469B1

(12) United States Patent
Weger, Jr.

(10) Patent No.: US 6,722,469 B1
(45) Date of Patent: Apr. 20, 2004

(54) GUARD PLATE AND SAFETY ANCHOR

(76) Inventor: Kenneth F. Weger, Jr., 3515 Oak Ridge Rd., Crystal Lake, IL (US) 60012-1665

( * ) Notice: Subject to any disclaimer, the term of this patent is extended or adjusted under 35 U.S.C. 154(b) by 0 days.

(21) Appl. No.: 10/172,128

(22) Filed: Jun. 14, 2002

(51) Int. Cl.[7] ..... E04G 5/02; E06C 7/06
(52) U.S. Cl. ..... 182/107; 182/214; 248/210
(58) Field of Search ..... 182/107, 214, 182/230, 129, 45; 248/210, 211, 238

(56) References Cited

U.S. PATENT DOCUMENTS 5,775,465 A * 7/1998 Vossler ..... 182/214
6,019,191 A * 2/2000 Flores ..... 182/107

* cited by examiner

*Primary Examiner*—Hugh B. Thompson, II
(74) *Attorney, Agent, or Firm*—Michael Best & Friedrich LLP

(57) ABSTRACT

A guard plate and safety anchor for securing a portable ladder and protecting the edge of a roof from mechanical forces generated by the weight of the user and the ladder, including a rigid flat plate sized for installation between a roof and a roof covering and having a mechanism for attaching the plate to the roof and a recess for receiving the ladder.

15 Claims, 1 Drawing Sheet

GUARD PLATE AND SAFETY ANCHOR

TECHNICAL FIELD OF THE INVENTION

This invention relates generally to roof protectors and, more particularly, to devices which may be attached to the edge of a roof for minimizing or eliminating damage to the roof including shingles or other roof coverings, any rain gutters, or any other structures located in the vicinity of the roof's edge.

BACKGROUND OF THE INVENTION

Portable ladders are commonly propped against the eave of a roof, or a soffit or a rain gutter located immediately beneath the eave, in order to gain access to or descend from the roof. If the upper end of the ladder slides laterally along the eave, for example, as a result of high winds, the climber may fall to the ground and suffer serious injury, not to mention costly damage to the roof system and/or gutter. Similarly, if the upper end of the ladder swings up and away from the roof, the climber may fall and be injured.

The repair cost of roof damage properly includes the cost of repairing immediate physical damage and, also, longer term damage due to structural deterioration and the rotting of exposed wood. This longer term damage is almost always present to some extent, and can be very expensive.

A variety of ladder supports and associated safety devices have been reported for preventing slippage of the ladder. Some of these devices attach to the roof or the wall of a building, while others attach to rain gutters mounted on the building. In many cases, attaching a ladder support to a rain gutter provides a false sense of security, because the rain gutter may not be reliably mounted on the building or of sufficient structural strength to support the ladder. Because inspection of the rain gutter to determine its reliability as a ladder support is best done from a ladder, attaching the ladder support to the rain gutter cannot be considered a reasonable solution.

One previously known safety device includes a sturdy U-shaped roof bracket connected by a hinge to a rigid loop for placing around the upper end of a ladder. The device is described in U.S. Pat. No. 5,775,465 issued to Vossler. While the device was commendable in its day, it is relatively difficult for a user to thread the upper end of the ladder through the rigid loop while the device is attached to the roof and the user is standing on the ground. Conversely, the device is difficult to attach to the roof while standing on the ladder, because the device is intended to protrude from the roof at precisely the point where the ladder rests.

Additionally, the device described in the '275 patent is U-shaped with relatively long and narrow legs which are ill-suited for attaching to a roof covered with shingles. The narrow legs are necessarily too long to fit beneath a single row of common roofing shingles and the second row of shingles cannot be simply pushed up as may be done with the first row. Instead, the second row of shingles must be removed by extracting the roofing nails, which hold them in place. The only practical alternative is to mount the device on top of the roofing shingles by making holes through the shingles, as depicted in FIG. 1 and FIG. 2 of the '275 patent, thereby ruining their ability to seal against rain. Neither method of attaching the '275 patent device to a roof with roof shingles is entirely satisfactory.

On the other hand, most ladder support apparatus which attach to the roof or wall to enhance the safety of a climber do little or nothing to protect the roof from damage caused by the upper end of the ladder. For example, a safety ladder device is described in U.S. Pat. No. 4,043,275 issued to LeBlanc. A significant fraction of the weight of the ladder and climber tends to force the upper end of the ladder toward the roof, so as to cut the roof covering and crush the eave. Also, if the upper end of the ladder slides laterally, it may strip off the roof covering, particularly shingles.

The danger of personal injury and the high cost of roof repair combine to make the roof an expensive place to try out new equipment or procedures. The above-described attempts at innovation demonstrate that ladder support and roof protection equipment is relatively expensive to construct and install and, in some cases, requires more structural backing than is actually present in existing buildings.

Therefore, a need still exists for a guard plate which makes ascending to and descending from a roof less likely to damage the roof and relatively safer for the climber. Preferably, the guard plate protects the edge of the roof from mechanical forces generated by the weight of the user and the ladder. Most preferably, the guard plate is compact, weighs relatively little and may be secured under the roof covering.

SUMMARY OF THE INVENTION

The invention provides a guard plate and safety anchor for a portable ladder. The invention makes access to the roof by climbing up the ladder relatively safer and less likely to damage the roof. The guard plate protects the edge of the roof, and any rain gutter which may be present, from mechanical forces generated by the weight of the user and the ladder. Additionally, the guard plate secures the upper end of the ladder so that it cannot shift laterally, making access to the roof relatively safer for the climber. The guard plate weighs relatively little, compared to previously known safety anchors, can be constructed in substantially flat form to facilitate storage, transportation and installation and, unlike previously mentioned attempts, is very inexpensive.

The guard plate can be permanently installed to facilitate access to the roof from the same area repeatedly. The invention may be employed to protect Ethylene Paopylene Diene Monomer (EPDM), asphalt, fiberglass or metal roofs, among others. The protected roofing covering may be shingles, tiles or rolls, or poured in place. The guard plate can be installed under or over the roofing covering.

When shingles are the roofing material, the guard plate is preferably installed beneath the shingles in order to avoid exposing the heads of roofing nails to the weather. The guard plate should be inserted beneath a single row of common roofing shingles. For a roof which has an existing covering of shingles, this can be done by simply removing one row of roofing nails and reinserting the nails so that they hold the shingles down and secure the guard plate to the roof. If a new covering of shingles is to be installed, the guard plate should be placed directly on the roof, and the new shingles should be fastened over the shingles by driving roofing nails through both the shingles and the guard plate. In a preferred form, the guard plate includes a cleat or an eyelet for attaching bungee cords, ropes, cables, tie ropes or chains which may be passed laterally across the upper end of the ladder.

In one embodiment, the invention is a guard plate, which includes a plate member having a generally flat face. The plate member is sized appropriately for installation between a roof and a roof covering. The guard plate also includes means for attaching the plate member to the roof so that a portion of the plate member extends approximately to or beyond the edge of the roof for receiving a ladder and for shielding the roof from damage by the ladder. The plate member may be attached to the roof without making any incisions in the roof covering. Installing the plate member between the roof and the roof covering does not substantially decrease the effectiveness of the roof covering for protecting the roof from wind, rain, and other forces of nature. Alternatively, the plate member may be installed over the roof covering, but additional sealing will be required and cosmetic issues arise. When the roofing covering is EPDM, plate member installation over the EPDM is preferred.

The guard plate preferably includes a fastening portion and a projecting portion. The fastening portion is for fastening a line to secure the ladder with respect to the guard plate. The projecting portion extends beyond the protecting edge and cooperates to define a recess for impeding lateral movement of the ladder.

DETAILED DESCRIPTION OF PREFERRED EMODIMENTS

Figure 1:
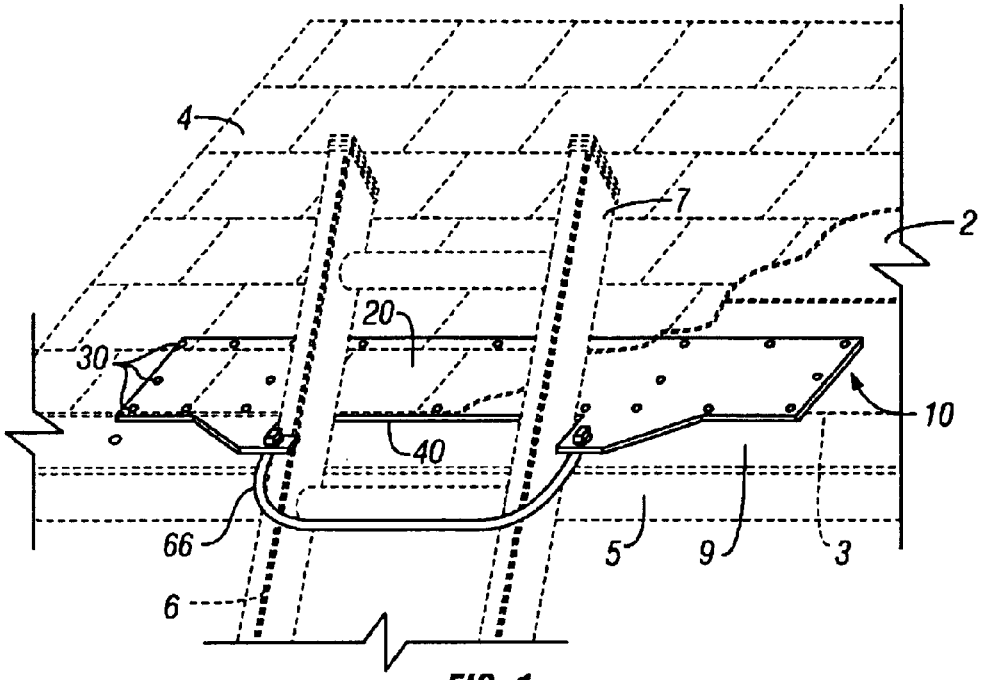
FIG. 1 is a perspective view of a guard plate of the present invention, which is mounted close by the edge of a conventional roof served by a conventional rain gutter.

In a preferred embodiment, the invention is a guard plate, such as guard 10 which FIG. 1 depicts as installed for use on a typical building. While roof 2 is shown as a pitched roof, guard 10 is equally effective when used with a horizontal roof. Roof covering 4 extends outwardly to edge 3 of roof 2 and, typically, a bit beyond in order to ensure complete coverage. Ladder 6, as illustrated in FIG. 1, leans against plate member 20, and is received by protecting edge 40 which extends approximately to or beyond edge 3 for receiving ladder 6 and for shielding roof 2 and roof covering 4 from damage by ladder 6.

Roof covering 4 is composed of EPDM, asphalt, fiberglass or metal, among other things. Roof covering 4 is constructed from shingles, tiles, sheets and/or rolls, for example, or, alternatively, formed in place by applying a suitable liquid to roof 2.

Guard 10 includes plate member 20 which has a generally flat upper face 22 and a generally flat lower face 23. Plate member 20 is sized for installing between roof 2 and roof covering 4, without adversely affecting the protection from rain, snow, ice, wind, sun and other natural elements which roof covering 4 ordinarily provides. For example, plate member 20 is about as thick as a common shingle, preferably about one-eighth of an inch thick, so that plate member 20 is relatively rigid and durable and still fits beneath roof covering 4 without impairing its ability to seal against rain. Preferably, plate member 20 is of an appropriate size to lie substantially beneath a single row of shingles, without the need to disturb adjacent rows of shingles. More preferably, plate member 20 is in the range of about 1 to about 8 feet in width and in the range of about 4 to about 18 inches in height. Ideally, plate 20 is about 4 feet in width and about 12 inches in height.

Plate member 20 includes a plurality of holes 30 which may be used with nails, screws, or other fasteners to attach plate 20 to roof 2. Alternatively, plate member 20 may be attached to roof 2 by means of an adhesive compound. In a preferred embodiment, plate member 20 is composed of a tough but punctureable material which can be nailed to roof 2 without any need for holes 30.

If guard 10 is installed at the time a new roof covering is being constructed, it is usually advantageous to attach plate member 20 directly to roof 2, and to construct roof covering 3 over plate member 20. The presence of plate member 20 does not detract from the durability or weatherproofing of roof covering 3, and the construction is wonderfully quick as any fasteners required to attach roof covering 3 can be driven right through plate member 20.

On the other hand, if guard 10 is installed on a roof with an existing covering, plate member 20 may be placed either below or on top of roof covering 3 and fasteners for attaching plate member 20 to roof 2 can be located below roof covering 3 or driven through roof covering 3, as desired.

Plate member 20 is composed of a relatively rigid material, such as sheet metal, carbon fiber or a sturdy polymer. The material is sufficiently rigid to permit protecting edge 40 to support upper end 7 of ladder 6 and, thereby, protect roof 2 and roof covering 4 from damage. Preferably, protecting edge 40 is composed of a non-skid material, such as natural or synthetic rubber, for providing a relatively high co-efficient of friction when placed in contact with upper end 7 of ladder 6, which is typically constructed of wood or aluminum. This non-skid material tends to hold upper end 7 in place relative to protecting edge 40 and resists any tendency for upper end 7 to slide laterally along edge 3.

Plate member 20 may be composed of a metal such as an aluminum alloy. Aluminum alloys ranging from relatively soft alloys, such as AL3003, to relatively hard alloys, such as AL6061 are preferred. These aluminum alloys can be punctured by a fastener, such as a nail for attaching to roof 2, yet are sufficiently rigid in sheets having a thickness of about 0.090 to about 0.125 inches to protect edge 3 against forces generated by ladder 6. These aluminum alloys are also relatively light in weight, having densities of about 0.098 to about 0.099 pounds per square inch. A guard plate which is substantially similar to guard 10 and constructed of one of these aluminum alloys with a width of four feet, a height of 12 inches and a thickness of about one-eighth of an inch typically weighs no more than about seven pounds.

A vertical wall portion, commonly known as a soffit, is typically located directly beneath the eave or edge 3. Additionally, rain gutter 5 may be mounted on soffit 9, as shown in FIG. 1. Soffit 9 and rain gutter 5 can be damaged by upper end 7 in the event that ladder 6 slips laterally to the point where it is no longer supported by roof 2. By resisting any tendency for upper end 7 to slide laterally with respect to guard 10, protecting edge 40 protects soffit 9 and rain gutter 5 from being struck by upper end 7.

Figure 2:
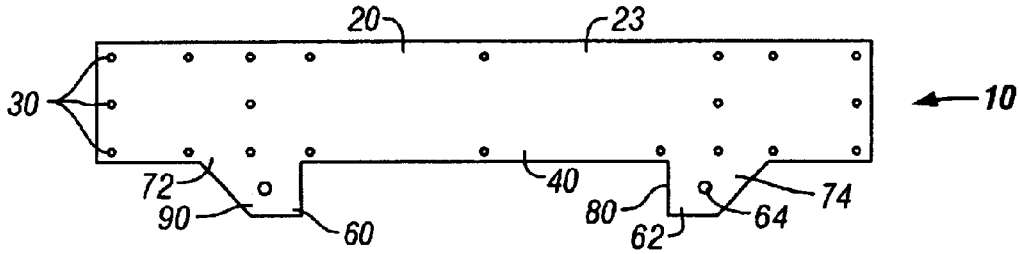
FIG. 2 is plan view of the guard plate depicted in FIG. 1.

FIG. 2 is an elevation view of guard 10 showing projecting portions 72, 74, which extend beyond protecting edge 40 and cooperate with protecting edge 40 to define recess 80. Preferably, recess 80 is slightly wider than the width of ladder 6, so as to form a cove or harbor in which upper end 7 may rest as it leans upon receiving portion 40. Recess 80 tends to impede lateral movement of ladder 6 and, preferably, limit the lateral movement of the ladder to a relatively narrow range lying between projecting portion 72 and projecting portion 74. Preferably, the distance between projecting portions 72, 74 is at least equal to the width of the widest ladder intended for use with guard 10. Preferably, the projecting portions 72, 74 extend about 1 ½ inches or less from protecting edge 40. Any projection which extends more than about 1 ½ inches from protecting edge 40 is undesirable, because such a projection may extend past upper end 7 of ladder 6 to entangle a climber's clothes or interfere with scaffolding. Guard 10 may be installed by a user standing on ladder 6. The user lifts the edge of roof covering 4 at eave 3 and slides guard 10 between roof 2 and roof covering 4. Guard 10 is maneuvered so that both of the side pieces of ladder 6 are in recess 80 and between projecting portions 72, 74. Then, guard 10 is drawn toward ladder 6 so that protecting edge 40 is in an appropriate position with respect to eave 3, and guard 10 is fastened to roof 2 by, for example, driving roofing nails through holes 30 into roof 2. Preferably, when previously installed shingles compose roof covering 4, one row of roofing nails is removed and reinserted with guard 10 in place, so as to secure the row of shingles and attach guard 10 to roof 2. Roof covering 4 is preferably placed over guard 10. Alternatively, guard 10 may be placed on top of roof covering 4 and attached to roof 2 by driving nails or other fasteners through roof covering 4. In that case, applying a sealant to protect any new holes in the roof covering or exposed nail heads is recommended.

Although holes 30 are useful, guard 10 may be attached to roof 2 by driving nails or other fasteners through guard 10 without the benefit of previously prepared holes. Holes 30 serve to facilitate nail driving and to remind the user to avoid placing nails too close to each other or too close to the edge of guard 10.

With guard 10 permanently installed to roof 2, the user can safely and easily place ladder 6 to obtain access without damaging roof 2 or roof covering 4. In this regard, guard 10 serves a function much like that of ajack point on an automobile. The user stands on the ground and lifts ladder 6 so that upper end 7 enters recess 80 and, preferably, touches protecting edge 40. The side piece is maneuvered laterally so that it comes to rest between projecting portions 72, 74. Then the other side piece is maneuvered into recess 80 and into contact with protecting edge 40. After lower end 8 of ladder 6 passes a final check for proper placement and solidity of support, the user may ascend. Upon reaching upper end 7, the user fastens the ends of line 66 to eyelets 64 so that line 66 laterally crosses and secures upper end 7 to guard 10.

Also shown in FIG. 2 are fastening portions 60, 62 for securing ladder 6 with respect to guard 20 by means of line 66. Line 66 may be, for example, a rope, a chain, a cable, a bungee cord, a strap or a wire. Eyelets 64, as shown in FIG. 2, are included in fastening portions 60, 62 to receive line 66. Line 66 passes laterally from one of the fastening portions to the other of the fastening portions to secure ladder 6 with respect to guard 10. Alternatively, both ends of line 66 may be attached at one of eyelets 64 to form a loop which surrounds a portion of ladder 6. Line 66 may be attached to eyelet 64 by hooks, bolts, snap-rings or knots, among other things. The purpose of line 66 is to prevent upper end 7 of ladder 6 from swinging up and away from guard 10.

Figure 3:
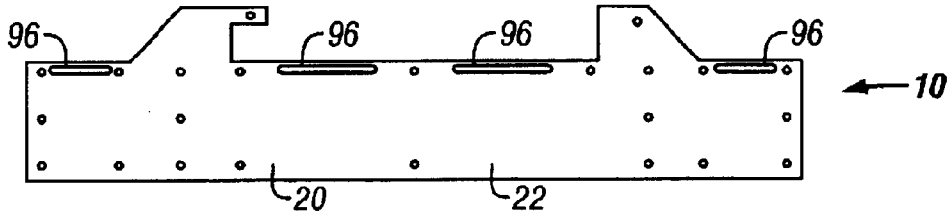
FIG. 3 is a bottom view of the guard plate depicted in FIG. 1.

Lower face 22 of plate member 20 is shown in FIG. 3. Locating portions 96 extend generally transversely from lower face 22 to facilitate proper placement of guard 10 for attaching to roof 2. Locating portions 96 may include a series of ridges, as shown in FIG. 3, which provide tactile feedback when locating portions 96 abut edge 3, soffit 9 or rain gutter 5. Locating portions 96 may include posts or angles to provide tactile feedback. Alternatively, locating portions 96 may include holes or notches to provide visual confirmation that locating portion 96 is in the correct position for attaching guard 10 to roof 2.

Figure 4:
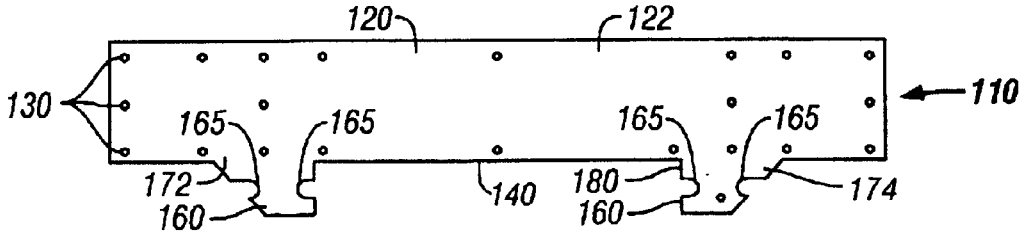
FIG. 4 is a plan view of a guard plate of the present invention.

Another preferred embodiment of the invention is depicted as guard 110 in FIG. 4. Elements of FIG. 4 which correspond to elements of FIG. 2 are designated with the same two final digits as the corresponding elements of the preferred embodiment described above. For example, plate member 120 of FIG. 4 corresponds to plate member 20 of FIG. 2.

Guard 110 differs from guard 10 in that cleats 165, rather than eyelets, such as eyelet 64 of FIG. 2, are provided for fastening a line to secure a ladder with respect to guard plate 110. The line may be fastened to cleat 165 directly or by use of a snap ring or similar connector.

While only a few embodiments of the invention have been described above, those of ordinary skill in the art will recognize that these embodiments may be modified and altered without departing from the spirit and scope of the invention. The embodiments described above are to be considered in all respects as illustrative and not restrictive.

What is claimed is:

1. A guard for protecting a roof or a roof covering from damage by a ladder, comprising:

a rigid, generally flat plate member having, means for receiving a ladder, the plate member sized appropriately for installation between a roof and a roof covering;

means for attaching the plate member to the roof so that an edge of the plate member extends to or beyond the edge of the roof for protecting the roof or the roof covering from damage by the ladder; and a fastening portion for fastening a line to secure the ladder to the guard in which the fastening portion includes an eyelet of appropriate size and strength for fastening a line to secure the ladder to the guard, wherein the receiving means include a recess for receiving the ladder and impeding lateral movement of the ladder, the recess being formed by at least two portions of the guard projecting from the protecting edge, the protecting portions being spaced at least the width of a ladder intended to be positioned within the recess.

2. The guard of claim 1 in which the plate member includes a locating portion which extends generally transversely from the face to facilitate proper placement of the guard for attaching to the roof.

3. The guard of claim 1 including a fastening portion for fastening a line to secure the ladder to the guard.

4. The guard of claim 1 in which the plate member is composed of a punctureable material which can be nailed to the roof.

5. The guard of claim 1 in which the plate member is composed of a relatively rigid sheet metal material selected from the group consisting of a soft aluminum alloy, a hard aluminum alloy, carbon fiber, and polymer.

6. The guard of claim 1 in which at least a portion of the recess is lined with a material which exhibits a relatively high coefficient of friction when placed in contact with the ladder, so that movement of a ladder with respect to the projecting edge is impeded.

7. The guard of claim 1 in which the plate member is composed of a punctureable material, and means for attaching the plate member to the roof includes fasteners which are driven through the plate member to engage the roof.

8. The guard of claim 7 in which the plate member includes preformed holes, and means for attaching the plate member to the roof include fasteners which extend through the plate member to engage the roof.

9. A guard for protecting a roof or a roof covering from damage by a ladder, comprising:

a rigid, generally flat plate member having means for receiving a ladder, the plate member sized appropriately for installation between a roof and a roof covering;

means for attaching the plate member to the roof so that an edge of the plate member extends to or beyond the edge of the roof for protecting the roof or the roof covering from damage by the ladder;

a fastening portion for fastening a line to secure the ladder to the guard in which the fastening portion includes a cleat of appropriate size and strength for fastening a line to secure the ladder to the guard, wherein the receiving means include a recess for receiving the ladder and impeding lateral movement of the ladder, the recess being formed by at least two portions of the guard projecting edge, the projecting portions being spaced at least the width of a ladder intended to be positioned within the recess.

10. The guard of claim 9 in which the plate member includes a locating portion which extends generally transversely from the face to facilitate proper placement of the guard for attaching to the roof.

11. The guard of claim 9 in which the plate member is composed of a punctureable material which can be nailed to the roof.

12. The guard of claim 9 in which the plate member is composed of a relatively rigid sheet metal material selected from the group consisting of a soft aluminum alloy, a hard aluminum alloy, carbon fiber and polymer.

13. The guard of claim 9 in which at least a portion of the recess is lined with a material which exhibits a relatively high coefficient of friction when placed in contact with the ladder, so that movement of a ladder with respect to the projecting edge is impeded.

14. The guard of claim 9 in which the plate member is composed of a punctureable material, and means for attaching the plate member to the roof includes fasteners which are driven through the plate member to engage the roof.

15. The guard of claim 14 which the plate member includes preformed holes, and means for attaching the plate member to the roof include fasteners which extend through the plate member to engage the roof.

* * * * *